US006309015B1

(12) United States Patent
Pine

(10) Patent No.: US 6,309,015 B1
(45) Date of Patent: Oct. 30, 2001

(54) HANDLE-OPERATED ROCKER RECLINER HAVING ROCKER LOCKS ON BOTH SIDE LINKAGES OF MECHANISM

(75) Inventor: James J. Pine, Tupelo, MS (US)

(73) Assignee: Action Industries, Inc., Tupelo, MS (US)

( * ) Notice: Subject to any disclaimer, the term of this patent is extended or adjusted under 35 U.S.C. 154(b) by 0 days.

(21) Appl. No.: 09/384,059

(22) Filed: Aug. 26, 1999

(51) Int. Cl.[7] ..... A47C 1/02
(52) U.S. Cl. ..... 297/85; 297/DIG. 7
(58) Field of Search ..... 297/68, 85, 258.1, 297/259.2, 259.1, DIG. 7

(56) References Cited

U.S. PATENT DOCUMENTS 3,279,847 10/1966 Re .
3,322,459 * 5/1967 Hampton .
3,493,264 2/1970 Re .
3,730,585 5/1973 Rogers, Jr. et al. .
3,767,257 10/1973 Rogers, Jr. et al. .
4,437,701 3/1984 Mizelle .
4,601,513 7/1986 Pine .
4,707,025 11/1987 Rogers, Jr. .
5,121,967 * 6/1992 Rogers .

* cited by examiner

*Primary Examiner*—Milton Nelson, Jr.
(74) *Attorney, Agent, or Firm*—Pillsbury Winthrop LLP

(57) ABSTRACT

On a spring-assisted handle-operated rocker recliner, each side linkage is provided with a forward and a rear landing gear. On each side, the links on which the contact elements (such as rollers) are mounted, are pivoted at intermediate locations on each, to the main flange of the respective side linkage. The ends nearest to the middle of the respective rocker cam are both pivoted to a set of links that, in effect, pull up those ends as the handle, and therefore the torque tube, is rotated to thrust the ottoman, and to push down those ends as the torque tube is rotated to retract the ottoman. The flange on each side linkage is provided with slots, which are enlarged at one end for facilitating mounting the flange on the respective rocker cam.

15 Claims, 4 Drawing Sheets

HANDLE-OPERATED ROCKER RECLINER HAVING ROCKER LOCKS ON BOTH SIDE LINKAGES OF MECHANISM

BACKGROUND OF THE INVENTION

As a user of a rocker recliner begins to move or project the ottoman (also known as a leg rest or foot rest) from a closed, stowed condition in which the recliner is fully upright, the person's feet almost immediately leave contact with the floor. Experience has shown that as the act of reclining proceeds, it becomes progressively more important for the confident and trouble-free enjoyment of the recliners, that the capability of the seating unit to rock, relative to its base become restricted and then prevented. To this end, the best-designed rocker recliners, include rocker locks which limit forward rocking in order to prevent the lower edge of an upholsted board of the ottoman from being driven into the floor because the chair occupant has shifted too much of their weight forwards while turning the mechanism-operating handle (or otherwise initiating thrusting of the ottoman). Additionally or alternatively, rocker locks are provided which, as reclining proceeds, more or less progressively act to prevent or restrict rearward reclinability, so that the user who shifts their weight backwards more vigorously than is best, but sill within reason, will not get a scare as they are rotating backward and their feet are elevating, too quickly for them to feel comfortable and maintain their composure.

Action Industries, Inc. has produced and marketed several generations of rocker recliners (also known as reclining chairs), which have rocker locks. Various designers have contributed to the mechanical and aesthetic designs of those chairs, and those designs have evolved with the passage of time. Several prior patents provide convenient 'snapshots' of how some of those chairs were provided with rocker locks beginning in respective design generations.

The U.S. patent of Rogers, Jr. et al., U.S. Pat. No. 3,730,585, which issued May 1, 1973, shows an early Action rocker recliner which was sometimes known as the #6000 recliner. In FIG. 4A of that patent, a side view of rocker lock is shown as the chair is in its intermediate (TV) position. Three-position recliners have an upright position, a TV or intermediate position, and a fully reclined position, respectively, in which the back is upright and the ottoman is stowed, the back remains upright or nearly so and the ottoman is fully projected, and the back is tilted down and the ottoman remains fully projected and is somewhat elevated. In many designs, as the chair is further reclined from the TV to the fully reclined position, the seat translates forward, upward, and tilts rearward. These actions more stabily position the user's center of gravity over the chair base, and reduce the clearance from a wall needed for tilting down the chair back without its upper rear edge striking the wall. Some chair bases are designed to sit directly on a floor (whether or not the floor is carpeted), while, on others, a rotary turntable attached to the underside of the base, without necessitating other changes, upgrades the rocker recliner to being a swivel rocker recliner. Whereas rocker recliners having handle-operated mechanisms are very popular, in order to appeal to an even wider of potential users, various designers have adapted handle-operated mechanisms, or designed new ones 'from scratch', where pulling on a ring, pulling a lever or pushing a button to release a catch, or rocking an electrical switch starts a motor, in order to allow or cause the chair mechanism to operate.

In the '585 patent, the rocker lock is located to the front of the base and cam (i.e. rocker) assemblies. An advantage of the rocker lock shown in the '585 patent is that it offered uninhibited rockability (so-called free-rock) when the chair was in its closed (i.e. upright, fully erect) position, because there was in this position no contact of the rocker lock structure with the chair base. If and when the rocker lock shown in the '585 patent worked improperly, it was because the wheel of the lock would jump-over the 'catcher' structure provided for trapping it, or the wheel would so vigorously strike the catcher as to loosen or disconnect the catcher from the chair base.

A succeeding generation is depicted in the U.S. patent of Mizelle, U.S. Pat. No. 4,437,701, which issued on Mar. 20, 1984, has sometimes been referenced as the Mizelle version. While the rocker lock shown in Mizelle avoided the 'jump over the catcher problem', in various commercial iterations, with wear, some dissatisfactions arose due to restrictedness or sluggishness of rockability of the chair in its closed position, wear causing flat spots on the wheels, severe rubbing-together of lock parts, bending of lock parts, and damage to the chair base or cams.

The present inventor was involved in the design of a next-succeeding generation of rocker lock for Action recliner chairs. This rocker lock, sometimes referred to as the Pine version, is shown in the U.S. patent of Pine, U.S. Pat. No. 4,601,513, that issued on Jul. 22, 1986. The designing of this lock coincided with an evolutionary redesigning of a basic reclining chair mechanism, known as the 1800, which Action used (and uses) in the construction of many of its motion chairs. That rocker lock was intended to have the best features of its predecessors, while avoiding their shortcomings in commercial iterations. It has been largely successful in achieving those objections, particularly in commercial iterations in which the mechanism parts that are cut, stamped, pierced, boxed and bent from steel plate, are made from at least 7-gage stock, so as to avoid bending of the landing links.

In all three of the prior generations of rocker locks referred to above, the locks are center-mounted, which inherently introduces torsional stresses on chair frame members including wooden cross-members, wooden dowels, wooden corner blocks, staples and glue. Side-to-side 'jogging' or 'racking' of the chair frame sides as the lock is activated is practically impossible to avoid. Ways to mitigate those problems are known, such as by replacing small wooden corner blocks with full-length metal corner brackets screwed and bolted to the wooden frame.

Also, in all three of the prior generations of rocker locks referred to above, the rocker locks were (or are) 'passive' in their operational relationship with the side linkages of the motion chair mechanism. They are designed to lose motion as the torque tube is rotated for attaining the TV position, without adding any positive force or input to the side linkages to help the side linkages to achieve the TV position.

Particularly in the Action 1800 mechanism, as provided with the aforementioned Pine version of the rocker lock, in certain particularly exuberantly upholstered versions, the front end of the chair can exhibit a condition known as 'weakness', denoting a lack of robustness in completeness and alacrity of thrusting and retraction of the ottoman. Such weakness is most likely to be evident in a style where the front end is a fully upholstered pad-over, tuck-under chaise which acts something like a big rubber band, the more it is stretched-out or extended, the more restoration force is stored tending to retract the front end to a more relaxed, closed position.

The Action 1800 mechanism with the Pine version rocker lock is a handle-operated, spring-assisted mechanism. A certain spring or springs which are provided make it easier for the user to rotate the operating handle, for causing a knuckling (or toggling) action of the front end, as the ottoman is extended from its closed position. As the handle is rotated, the ottoman board moves away from the seat and starts to rise. As the handle continues to rotate, the ottoman board continues to trance out and up, until, almost at the end of the handle rotation, the ottoman board levels out and continues to extend further outwards, but stops rising. It is during this latter phase of handle rotation that knuckling or toggling of the mechanism occurs, such that the ottoman is able to support weight of a user's feet and legs acting downwardly, although a force pulling or pushing rearward on the ottoman can restrict its outward travel and may even prevent its attaining or maintaining its fully thrust position (and therefore the chair from achieving the TV position).

SUMMARY OF THE INVENTION

The present invention provides a rocker recliner with a rocker lock system which is carried by each side linkage of the mechanism. As the chair is opened from the closed to its TV position, each side of the chair becomes locked, without imparting the torsional stresses to the frame that a center-mounted rocker lock does.

In a preferred construction, the existing mechanism, minus its center-mounted rocker lock, is redesigned, to provide the necessary pivots for the side locks, and also to carry the pivots required for the existing recline linkages. The preferred construction utilizes slide-in side-mounting slots, allowing for faster assembly, and allowing for use of more cost-effective, easier to assemble and stronger plywood base and cam units.

The unique side lock system not only locks the chair into its TV position once that position is achieved, overcoming the problem of front-end weakness, but also produces a positive force that is directed back to each side linkage by an existing mechanism part connected to the torque tube, which force is then transferred by the torque tube to the ottoman links which control the thrusting of the ottoman. This positive force assists in causing the front end to knuckle and toggle.

In the preferred construction, no change to the chair frame is needed, and, in fact, an Action 1800 mechanism having the novel side locks can be used to retrofit previously manufactured Action rocker recliner chairs having the above-mentioned center-mounted Pine version rocker lock. A total of four new parts is required (that is fewer parts than the center-mounted lock). Drop-in seat springs can be provided on the chair, and the chair base is easily provided with a swivel.

In the new lock system, each side linkage is provided with both a forward and rear landing gear equipped with a roller. On each side, the links on which the rollers are mounted are pivoted at intermediate locations on each, to the main flange of the side linkage. The ends nearest the middle of the rocker cam are both pivoted to a set of links that, in effect, pull up those ends as the torque tube is rotated to thrust the ottoman and push down those ends as the torque tube is rotated to retract the ottoman. The flange on each side linkage is provided with slots, which are enlarged at one end for facilitating mounting the flange on the respective rocker cam.

BRIEF DESCRIPTION OF THE DRAWINGS

In this document a preferred embodiment of the invention is described in more detail below, with reference to the attached drawings, wherein:

FIG. 1 is a fragmentary vertical longitudinal sectional view of a motion chair provided with a center-mounted rocker lock. In this reproduction, a fragmentary detail view on an expand scale is designated FIG. 1A.

FIG. 2 is a fragmentary top plan view of the FIG. 1 chair. In this reproduction, two fragmentary detail views of portions shown circled by respective chain-dot lines in FIG. 2, on expanded,scales, are respectively designated FIGS. 2A and 2B.

FIG. 3 is a transverse-cross-sectional view of the torque tube and the handle and handle pivot link mounted thereto, showing in full lines the FIG. 1 position of this structure, and in dashed lines extreme positions and locus of movement of this structure as the handle is rotated to its opposite extremes. In this reproduction, a fragmentary detail view on an expanded scale is designated FIG. 3A.

DETAILED DESCRIPTION

Figure 1:
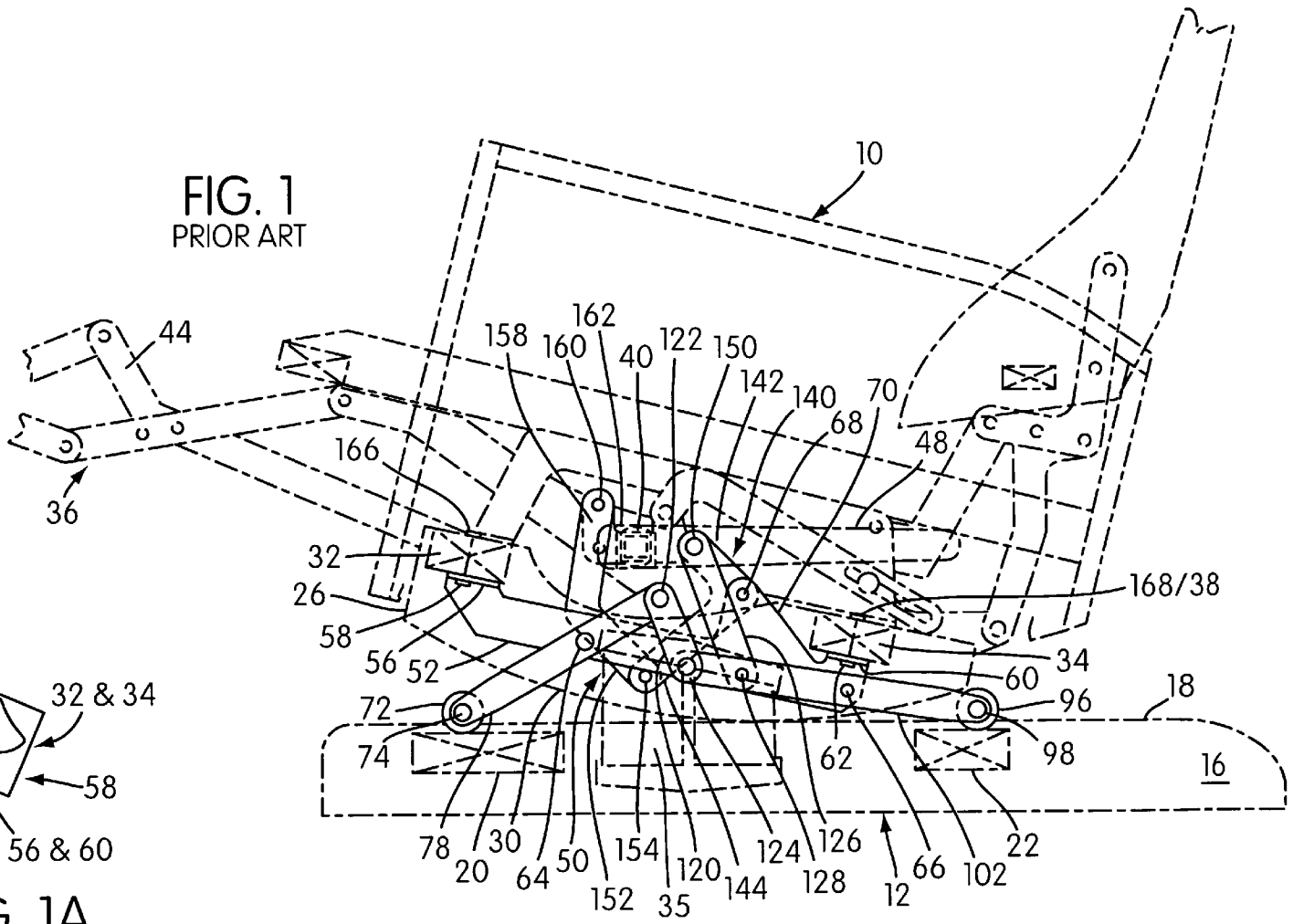
FIG. 1 PRIOR ART
FIGS. 1–3 are reproductions of the drawings from Pine, U.S. patent U.S. Pat. No. 4,601,513, referred to above in the background section, and therefore are designated PRIOR ART.
Figure 1A:
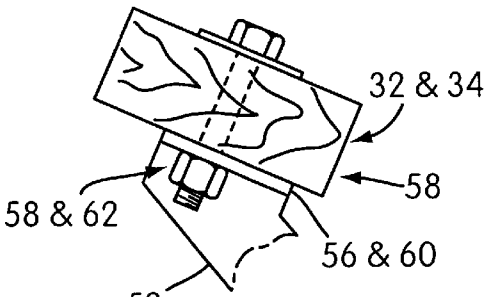
FIG. 1A PRIOR ART

Platform rockers, in which a rocker frame is rockably mounted on a platform base with the aid of counterbalancing springs and a handle-operated, that used lazy long-type side linkage mounted thrustable-retractable ottoman, where the left and right side linkages also serve to mount the chair backrest and the chair seat frame on the rocker frame, and where the left and right side linkages are coordinately operated by a torque tube, (i.e., a transverse shaft rotatably journalled in bearings provided in two corresponding links of the left and right side linkages and to one protruding outer end of which the operating handle is secured to extend radially therefrom) are so well known in the art that it is believed unnecessary to provide one of ordinary skill in the art with exhaustively complete representation of one in the drawings and description hereof. Interested readers are referred, e.g. to the previously mentioned U.S. Pat. No. 3,730,585, of Rogers et al.

The conventional structure of such a chair 10 is represented in FIG. 1 by a base frame 12, e.g. made, for example, of wood with mirror image left and right side members 14 and 16 providing floor-engaging feet, and upwardly-presented, horizontal, longitudinally extending left and right side rails 18 united by front and rear cross-members 20, 22 having upwardly presented surfaces 24. Typically, the base frame 12 is a fairly rigid, unitary assembly. The conventional structure is further represented in FIG. 1 by a rocker frame 26, also typically fabricated as a fairly rigid, unitary assembly made of wood, having left and right rocker cam members downwardly facing convexly arcuate cam surfaces 30 constructed and arranged to rockingly run on the rails 18, and front and rear cross-members 32, 34.

Conventional counterbalancing spring assemblies mounted between the corresponding rocker frame and base frame side members at the left and right for holding the chair on its platform with a predetermined, null position are exemplified by the one shown at 35.

Just enough of a typical far side linkage 36 of which the near side linkage, not shown, is a mirror image counterpart is shown in FIG. 1 as to suggest to the reader that each mounts to the respective side of the rocker frame 26, e.g. on or near the rear cross-member 34 at 38, where the transversally extending transverse member, i.e. the torque tube 40 is journalled therein for rotation in both angular senses about its own longitudinal axis, and the so called lazy tong, parallelogram, four-bar linkages or the like 44 to which the ottoman (not shown) is conventionally mounted for being thrust and retracted as the rotary movement of the torque tube 40 is operatively transmitted at 46 to the ottoman thrusting/retracting linkages when the handle 48 mounted to an end of the torque tube 40 is rotated a sufficient amount in the respective angular sense.

Some conventional motion chairs are purely rocking chairs with thrustable/retractable ottomans. In others, the degree of uprightness of the chair back relative to the chair seat and arm frame can be altered by the chair occupant, e.g. by "pushing-off" from the chair arms and leaning back while seated in the chair.

A fundamental unit of the rocker locking mechanism 50 is the mounting link 52. This link includes a longitudinally extending, main body 54 arranged in a vertical plane. At its top, adjacent its forward end, a portion of the blank of which the link 52 is formed is folded over so as to extend laterally, to the left or to the right, e.g. at a right angle to the plane of the main body 54 to provide an ear-like forward mounting flange 56. A hole bored through this flange 56 is fitted with a plug nut 58 press fit, adhered, spot welded and/or otherwise conventionally secured therein from below so as to effectively provide cooperative means for that flange.

Similarly at its top, adjacent its rear end, a portion of the blank of which the link 52 is formed is folded over so as to extend laterally, to the left or to the right, e.g. at a right angle to the plane of the main body 54 to provide an ear-like rear mounting flange 60. A hole bore through this flange 60 is fitted with a plug nut 62 press fit, adhered, spot welded and/or otherwise conventionally secured therein from below so as to effectively provide cooperative securement means for that flange.

Three horizontal, transverse axis pivot joints are shown provided on the main body 54, located respectively at 64 about one-third the distance there along from the forward end at a site that will come to be located below and about an inch forwardly of the torque tube when the rocker locking mechanism 50 is mounted to the chair frame; at 66 adjacent the rear end of the main body 54; and at 68 on a vertically upwardly extending ear 70 which places the pivot joint 68 approximately midway between the torque tube 40 and the rear cross member 34 of the rocker frame 26 and at about the same level as the torque tube 40.

Figure 2:
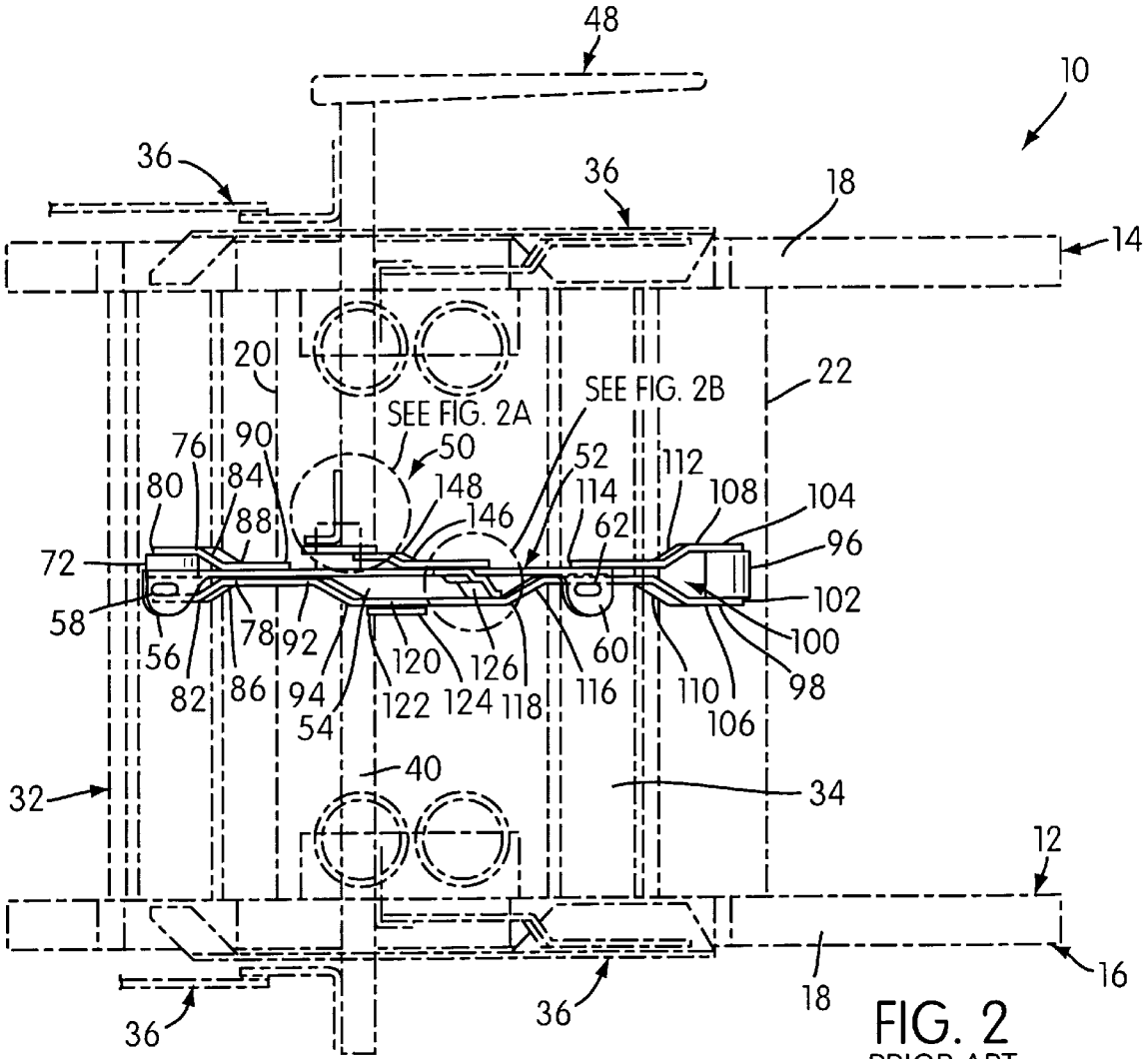
FIG. 2 PRIOR ART
Figure 2A:
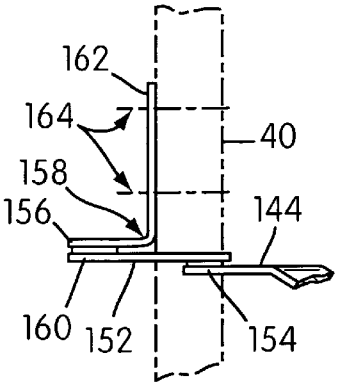
FIG. 2A PRIOR ART

The forward rocker lock is shown comprising a roller 72 rotatably journalled on a transverse axis horizontal axle 74 mounted in a forwardly opening yoke 76, shown in FIG. 2, provided by respectively bent portions of a front tilt link 78 and a front assist link 80. At the rear (base) of the yoke 76, the links 78, 80 are provided with shallow, obtuse angle Z-bends giving them oblique portions 82, 84 and longitudinally oriented rear portions 86, 88 which flank opposite lateral faces of the main body 54 of the mounting link 52. At 64, the portions 86, 88 of the links 78, 80 are pivotally mounted to the main body 54. The front assist link 80 ends at 90, but the front tilt link 78 is shown extending further longitudinally rearwardly, e.g. nearly another three inches, and in that portion being provided with another shallow, obtuse angle Z-bend giving the link 78 an oblique portion 92 and a longitudinally oriented rear portion 94 that is at least approximately coplanar with the part of the yoke 76 formed at the forward end of the same link 78. The rear end of the front tilt link 78 is located about an inch forwardly of the pivot joint 68 on the vertical flange 70 of the main body 54.

Similarly, the rear rocker lock is shown comprising a roller 96 rotatably journalled on a transverse axis horizontal axle 98 mounted in a rearwardly opening yoke 100 provided by respectively bent portions of a rear tilt link 102 and a rear assist link 104. At the front (base) of the yoke 100, the links 102,104 are provided with shallow, obtuse angle Z-bends giving them oblique portions 106, 108 and longitudinally oriented forward portions 110, 112 which flank opposite lateral faces of the main body 54 of the mounting link 52. At 66, the portions 110, 112 of the links 102, 104 are pivotally mounted to the main body 54. The rear assist link 104 ends at 114, but the rear title link 102 is shown extending further longitudinally forwardly, e.g. approximately another four inches, and in that portion being provided with another shallow, obtuse angle Z-bend giving the link 102 an oblique portion 116 and a longitudinally oriented forward portion 118 that is at least approximately coplanar with the part of the yoke 100 formed at the rear end of the same link 102. The forward end of the rear tilt link 102 is located about an inch and a half below and slightly to the rear of the rear end of the forward tilt link 78. Adjacent these ends, these two links are joined by a forwardly, upwardly sloped, generally vertically extending toggle link 120 which is pivotally connected adjacent its own upper end to the front tilt link 78 by a transversally horizontally extending pivot joint 122 and adjacent is own lower end to the rear tilt link 102 by a transversally horizontally extending pivot joint 124. In the preferred construction, the toggle link 120 is located laterally outwardly of the two link ends to which it is pivotally joined.

At a site located about two-thirds of the distance forwardly of the pivot joint 66, towards the pivot joint 124, a lift link 126 is pivotally connected adjacent its lower end, by a transversally extending horizontal axis pivot joint 128 to the forward portion 118 of the rear tilt link 102.

It should now be apparent that the basic activation/deactivation of the lock mechanism 50, in which the front and rear landing gear comprising the respective forward and rear yoke-mounted rollers is effected by appropriately pulling-up and pushing-down on the lift link 126. The remaining links and pivot joints to be described are constructed and arranged for providing that pulling and pushing action when the legrest of the chair is thrust and retracted and/or the chair back is reclined and erected, while accommodating lost motion between the torque tube 40 and the lift link 126 lower pivot joint 128 as the chair is rocked with the back erect and the legrest stowed.

The lower end of the lift link 126 flanks the medial face of the forward portion of the rear tilt link 102, i.e. the opposite face from that flanked by the lower end of the toggle link 120.

Figure 2B:
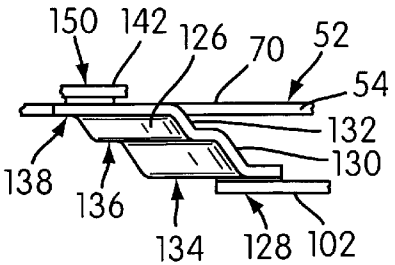
FIG. 2B PRIOR ART

The lift link 126 is shown in FIG. 2B as being provided with two successive shallow, obtuse angle Z-bends, so that its two oblique portions 130,132 are oblique in the same angular sense and its three longitudinally oriented portions 134,136, 138 are located progressively more medially of the lock mechanism 50. This permits the lift link 126 to move along the side of the vertical flange 70 of the main body of the mounting link 52 without engaging or interfering with that link, yet places the uppermost end portion 138 of lift link 126 substantially in the same plane as the vertical flange 70. (In operation of the lock mechanism 50, the lift link upper end portion moves in an arc which curves in front of the vertical flange 70 to over top of that flange, generally spacedly following the contour of that flange 70.)

A bell crank link, of generally inverted L-shaped profile, is shown provided at 140. This link 140 has a shorter leg 142 and a longer leg 144. At its crux, the link 140 is pivotally joined to the vertical flange 70 of the main body 54 by the pivot joint 68. In the preferred construction, the bell crank link 140 flanks the opposite face of the main body 54 from that flanked by the lift link 126 its upper short leg 142 projects forwardly from the joint 68, and its longer leg 144 rotates from being more vertically downwardly oriented when the lock mechanism 50 is fully retracted, to being more forwardly projecting when the lock mechanism 50 is fully activated. The longer leg 144 is shown provided near its outer end (i.e. its end furthest from the pivot joint 68) with a shallow, obtuse angle Z-bend that provides and oblique portion 146 and a longitudinally aligned end portion 148, e.g. located in a plane that is slightly beyond the plane of the side of the forward yoke provided by the front assist link 80.

The outer end of the short leg of the bell crank link 140 is shown pivotally connected to the upper end of the lift link 126 by a transversally extending horizontal axis pivot joint 150. And the outer end of the long leg of the bell crank link 140 is shown pivotally connected to the lower end of a pull link 152 by a transversely extending horizontal axis pivot joint 154. The upper end of the pull link 152 is shown pivotally connected to the forward end of the short vertical flange 156 of a handle pivot link 158 by a transversally extending horizontal axis pivot joint 160. The pull link 152 is shown being planar and banana-shaped (convex forwardly), in order to permit its upper end to pivot around the torque tube without the rear edge of the pull link engaging or interfering with the torque tube. The handle pivot link vertical flange 156 is generally L-shaped, with the joint 160 being provided at the outer end of its forwardly projecting leg. The upper (outer) end of the other leg of the handle pivot link is shown bent-over at a right angle to provide a torque tube mounting flange 162, which extends laterally, e.g. about two inches and is provided with a series of, e.g. two openings 164 through the thickness thereof to provide for securement of this flange to the torque tube 40 of the chair.

In constructing the parts of the chair 10, the front and rear cross members 32 and 34 of the rocker frame are pre-drilled vertically through the thickness thereof to provide lock mechanism mounting holes 166, 168 and the torque tube 40 is cross drilled at a series of corresponding site there along to provide lock mechanism mounting holes 170. In assembling the chair 10, the flanges 56, 60 are placed against the undersides of the cross members 32, 34 and bolts 172 are run down tight through the pre-drilled slotted holes 166, 168 or into the plug nuts 58, 60 and after the mounting flange 162 is abutted with the correct face of the torque tube 40, nut and bolt assemblies 174 are installed through aligned openings 164, 170 to secure the mounting flange 162 to the torque tube 40.

The angular extents, lengths, pivot locations, juxtapositions and other physical relationships of the parts may, for example, be as shown, What is important is that when the occupant is using the chair to rock, with the chair back erect and the leg/rest/foot/rest/ottoman or like structure retracted so that the occupant can still control rocking by alternating foot pressure on the floor to the front of the base of the chair, the rollers at the "business" ends of the front and rear landing gears are retracted (elevated) sufficiently above the cross members 20, 22 of the base frame 12 as to freely permit as great a degree of rocking amplitude as the occupant wishes, limited only by roller engagement on the cross member 20 or on the cross member 22 only when the chair has been rocked forwardly or rearwardly by such an extreme amount that further rocking in the respective direction would put the occupant in danger of tipping over in the chair. In other words, when the person wants to rock, he or she can freely rock as much as he or she wants, within maximum limits of prudence established by the chair manufacturer.

What is further important, is that when the chair occupant begins to rotate handle 48 to operate the side linkages 36 to raise/extend/thrust the foot/rest/leg/rest/ottoman, the connection of the lock mechanism 50 to the torque tube 40 at 174 causes the lock mechanism to begin to be activated progressively lowering the front landing gear at a faster rate, by a greater magnitude than the rear landing gear is being lowered, so that by the time the person's feet can no longer touch the floor, the front landing gear is sufficiently down to prevent the ottoman from engaging or being driven into the floor as it is extended, and then is lifting the front of the rocker frame thus forcing the rockable part of the chair to tilt rearwardly by a desirable amount. At this time, the more slowly less dramatically lowering rear landing gear lands on the rear cross member 22 in time to prevent the chair from overbalancing to the rear (i.e. in time to keep it from tipping over backwards), as more of the weight of the person's trunk is borne on the backrest due to the rearward tilting of the rockable part of the chair.

The forward landing gear and/or the rear landing gear can be constructed and arranged to land on the floor instead of on a respective cross member 20 or 22, and/or the rollers can be replaced by non-rollable skids, e.g. made of lubricous synthetic plastic material.

During rotation of the handle 48 in the angularly opposite direction the forced canting and deprivation of rockability which were progressively imposed as the ottoman was extended are progressively extinguished in a reversal of the order in which they were caused by operation of the lock mechanism 50.

When the occupant has thrust the ottoman by rotating the ottoman-thrusting handle, likely without giving it a thought has set the lock 50 by causing the rotation of the torque tube to be translated into an upward pull on the lift link 126, pivoting the front and rear landing gear down. He or she may then lean back and/or push-off on the arms of the chair and, in a chair having a back that is tiltably mounted to the said linkages 36, cause the chair back to tilt back. It is conventional in the construction of motion chair mechanisms for such tilting to be accompanied by effectively accentuating the sensation of backward tilting by causing the act of tilting the backrest, e.g. acting through four bar linkages at both sides of the chair mechanisms, to swing the seat and arm frame in such a manner that the front of the seat tilts upwards by a few degrees. By virtue of the interconnection of the mechanism links, and of the handle to the seat and arm frame, this means that when in such chairs, it is usual for the torque tube to be translated upwardly along a short arc 180, as in FIG. 3A, relative to the rocker frame as the chair back is reclined. Accordingly, it is important in the design of the lock mechanism 50 that, if it is going to be mountable on a motion chair which has a thrustable ottoman and is both a platform rocking chair and a reclining chair, both that raising of the torque tube along the arc 180 not cause damage to the lock mechanism 50 or to the chair, and that the lock mechanism not interfere with such use of the chair.

In the preferred construction of the lock mechanism of the invention, what these requirements translate to is that when the chair back is reclined, lifting the torque tube along the arc 180, that action must not cause any substantial further lifting of the lift link 126. As should be apparent from the drawings, the geometry of the preferred lock mechanism construction is such that when the ottoman is fully thrust, the upper end of the short leg of the bell crank link 140 is nearing the top of its arc about the pivot 68, so that the lift on the torque tube, in moving the lifting link 126 and thus somewhat further pivoting the bell crank link 140 simply carries the upper end of the lift link 126 rearwardly without substantially lifting the lift link 126 any further. This action is reversed in erecting the chair from a reclined state.

The rocker locking mechanism 50 preferably is fabricated using conventional techniques, using steel plate stampings, bored bent, riveted, pivotally pinned, provided with spacer washers, painted matte black and bolted to the rocker frame and torque tube. Preferably washer-like bushings for pivot joints and the rollers are made of a lubricious plastic material such as nylon, acetal resin or the like. In some instances, as should be apparent, the profiles of links of the rocker locking mechanism are dictated by the need for clearance as parts move past one another. In other instances what may look like arbitrarily placed notches in the profiles of parts are artifacts of arranging the patterns of the blanks of the links so that the greatest amount of them can be cut from the least amount of steel plate.

In the preferred construction according to the principles of the present invention, the medially positioned rocker lock that has been described above with reference to FIGS. 1–4, is replaced by two, mirror image, side-mounted rocker locks, the left one of which is illustrated in FIG. 4 and is further described herein below.

With articles of seating furniture, the terms "left" and "right" need a frame of reference, since what is the right side when facing the chair, is the left side when sitting in the chair. The term left side has been used in relation to FIG. 4, using the frame of reference of a chair occupant.

The description provided for the left side linkage is true in mirror image for the left side linkage. The left and right side linkages are integrated into a mechanism and coordinated in the movement of respective parts, by being secured to the opposite outboard vertical sides of the respective rocker cams, and mutually supporting the torque tube 40 for rotation about the transversely oriented (with respect to the chair) longitudinal axis of the torque tube, which has operating links correspondingly connected with the respective side linkages.

The left side linkage 210 is shown including a plate 212 which is generally vertically oriented, but elongated in a front to rear direction on the chair. This plate is provided with forward and rear openings 214, 218 preferably provided as slots having enlarged eyes (such are shown on the comparable parts in the FIGS. 1–3 construction), which permit the side linkages to be mounted on the laterally outer faces of the respective rocker cams, by slipping the slot eyes over the heads of respective, at first loosely installed, bolts 220. Then the side linkages are shifted rearwardly to slide the narrower portions of the respective slots 214, 218 behind the heads of the respective bolts, whereupon the bolts 220 are tightened. One or more additional bolts can then be installed through corresponding openings on each side.

Figures 3, 3A:
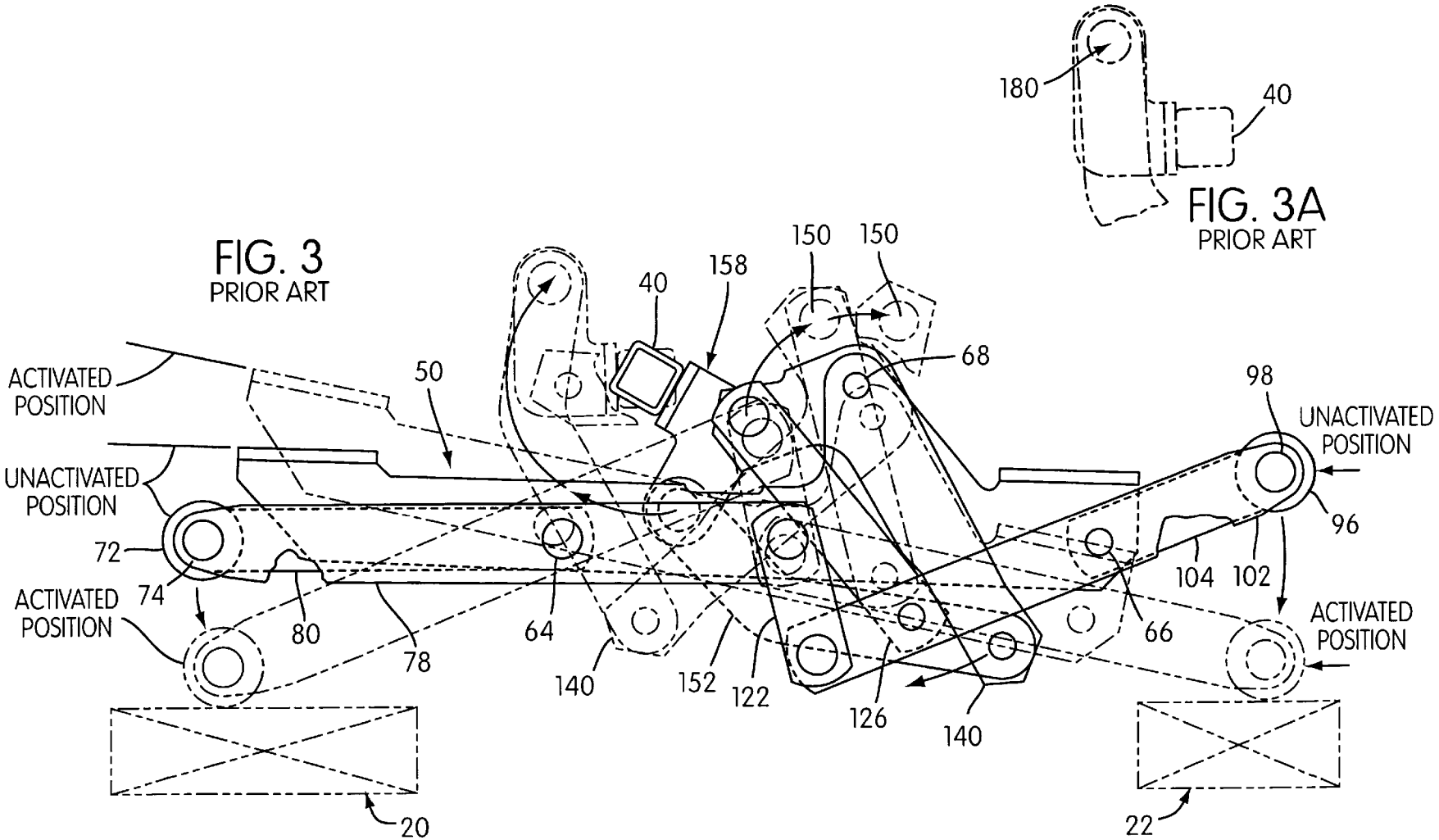
FIG. 3A PRIOR ART
FIG. 3 PRIOR ART

Each plate 212, in addition to mounting the structures which carry the upholstered ottoman on its projecting linkages, and mount the upholstered chair seat and arm frame unit, and the upholstered chair back, has has been described above with reference to the construction that is depicted in FIGS. 1–3, also serves as a base plate for the respective side-mounted rocker lock 222 of the present invention.

Each rocker lock 222 has a front landing link 224, which extends generally front to rear in a vertical plane, with a laterally outward offset near its rear end. At its front end, the front landing link 224 has a roller 226 (which could be a skid), arranged to land on and move in a front to rear direction along the horizontal, upwardly-presented surface 228 of one side member 230 of the chair base, the same surface on which the respective rocker cam is supported for being able to rock when the rocker lock is in its inactive position.

The rear end of the front landing link 224 is shown provided with a horizontally elongated slot 232 in which is slidingly received an element which is a combined transverse, horizontal axis pivot, a rivet and a slot follower 234.

Intermediate its forward and rear ends the front landing link 224 is mounted to the plate 212 by a transverse, horizontal axis pivot joint 236.

Each rocker lock 222 further has a rear landing link 238, which is generally L-shaped, oriented, so that one leg projects rear-wards and has a roller 240 (which, also, could be a skid) mounted at its rear end so as to be arranged to land on and move in a forward to rear direction on the upper surface 228 of the respective side member 230 of the base. At the juncture of the recumbent and upwardly projecting legs of the rear landing link 238 the link 238 mounts the slot-follower pivot 234. (It is possible to reverse the elements, such that the slot follower pivot 234 is provided where the slot 232 is shown located, and vice versa.) The upper end of the forward, upwardly projecting leg of the rear landing link 238 doglegs forwards and has a transverse, horizontal axis pivot joint 242. Intermediate its front to year extent, between the pivot 234 and the roller 240, the recumbent leg of the rear landing link is mounted to the respective plate 212 by a transverse, horizontal axis pivot joint 244.

An inverted, rearwardly facing fishhook-shaped link 246, has its lower end connected by a transverse, horizontal axis pivot 248 to a radially projecting crank link 250 to the torque tube 40. At the crest of its arch, the link 246 is connected by the transverse, horizontal axis pivot 242 to the upper end of the upwardly projecting forward leg of the rear landing link 238. The arch of the link 246 usually spacedly surrounds a medially projecting pin 254 fixed on the link 238 a little below the pivot 242, but when the ottoman linkages (as in FIGS. 1–3) are projected, the stop pins 254 are brought into engagement with respective sites on the respective inner edges of the respective arches on the respective links 246, to limit pantographic projection of the ottoman-mounting features of the respective side linkages 210.

Figure 4:
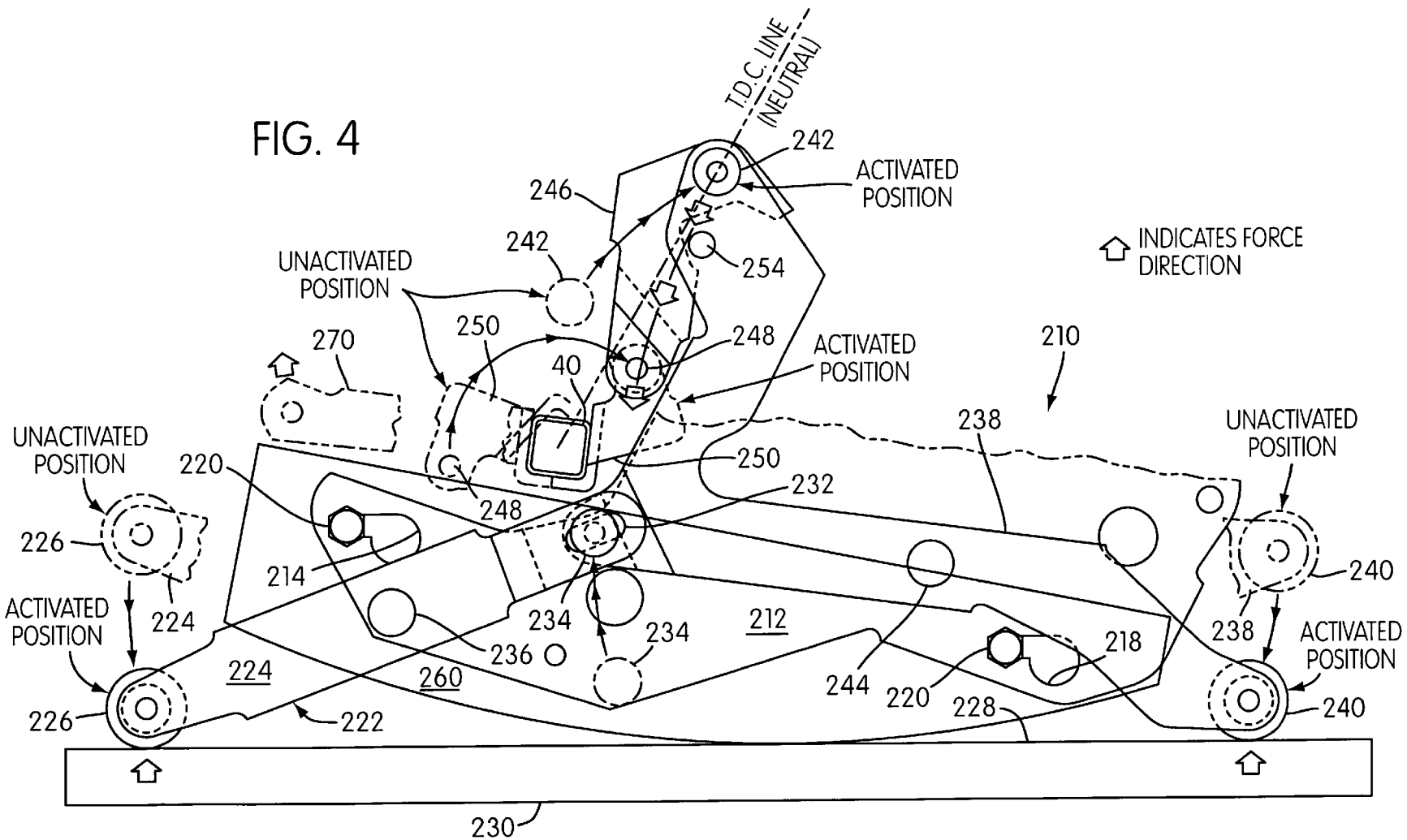
FIG. 4 is a fragmentary left side (non-handle side, in this iteration), from outboard looking medially, of a side linkage of a mechanism (shown in relation to the chair base and rocker cam, modified from that of FIGS. 1–3), in accordance with the principles of the present invention. The right side linkage (not shown) is correspondingly modified, and therefore, in regard to the modifications from the construction according to FIGS. 1–3, would appear as a mirror image of FIG. 4. In this Figure, the lock structure is shown in its active position (corresponding to the TV and fully reclined positions of the chair), and more fragmentarily in chain-dot lines in its inactive position, corresponding to the closed, fully erect position of the chair.

When the chair on which the rocker locks of the invention are provided is in its closed, fully erect position, with its ottoman fully retracted, the front and rear landing links 224, 238, and their respective rollers, have the respective unactivated positions that are fragmentarily shown in chain-dot lines in FIG. 4. In this position, the seat and arm frame unit, with the side linkages 210 also carrying the ottoman and chair back are free to rock relative to the base, with only the left and right conventional platform rocker spring units (not shown in FIG. 4) maintaining the rocker cams rockably associated with the base and tending to maintain a datum position, as regards forward-rear rocking to extremes of position.

In this position, the pivot 242 is at its highest, over top of the torque tube, and the link 246 has its front end curled down in front of the torque tube 40. As the handle (not shown in FIG. 4) on the right end of the torque tube is rotated to the rear, the crank link 250 is bodily rotated from a position in which it projects forwardly, up over the top of the torque tube 40, to a position where it projects somewhat rearwardly, thereby correspondingly moving the pivot 248 at the lower end of the link 246 a rearwardly concave, upwardly tracing arching movement. This correspondingly upwardly, and somewhat rearwardly moves the pivot 242, causing the forward and rear landing links 224, 238 to pivot about the respective intermediate pivots 236, 244, and therefore the rollers 226, 240 to be forced down into rolling (or, if skids, sliding) contact with the surface 228 of the base 230 (coordinatingly on each side of the chair).

In FIG. 4, a center line of arching movement is labeled "TDC" (for top dead center. If the torque tube 40 is considered to have a fixed location longitudinal axis (as the chair makes from its closed to TV positions) and pay attention to the upper and lower pivots on the link 246, the highest point in trajectory of movement is attained at or near the TDC line, at which the torque tube experiences a neutral zone, slightly beyond which the chair settles into the TV position, as forces are redirected downward and to the rear of the torque tube, helping to rotate the torque tube in the direction which fully achieves the TV position, in which the fully projected ottoman can withstand downward force without retracting.

The pin-in-slot arrangement 232, 234 allows the linkage geometry to be designed such that the front landing gear touches down first, then the pins travel in the slots until the rear landing gear touches down with the rockable part of the chair thereby forceably rocked somewhat to the rear by a predetermined amount from a datum position.

The rock-preventing position thereby assumed by the rocker locks is maintained not only so long as the chair is in the intermediate, TV position, but, through lost motion conventionally provided as the chair back is reclined by the user's pressing back on the upper part of the back while the chair is in the intermediate position. Then, after the user has returned the chair to the intermediate position by concentrating their weight downwards while easing-off pressure on the upper part of the back, the user can restore the chair to its fully closed position by reversely rotating the activating handle (not shown in FIG. 4) on the end of the torque tube 40, which causes a reversal of the movements described above.

It should now be apparent that the handle-operated rocker recliner having rocker locks on both side linkages of the mechanism as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed:

1. A rocker lock for a spring-assisted, handle-operated rocker recliner in which left and right rocker cams of a rocker cam frame of a rockable chair assembly are supported for rocking forwardly and rearwardly respectively on upwardly presented running surfaces of left and right rails of a base of the recliner, the rockable chair assembly further including a motion chair mechanism mounted to and supported on the rocker cam frame and including left and right side linkages which are coordinately interconnected by a transversely extending torque tube that is journalled for reversible rotation about a longitudinal axis of the torque tube, the torque tube having a handle secured on one end thereof for effecting manual rotation of the torque tube, an upholstered seat and arm frame unit mounted at corresponding sites to the left and right side linkages, an upholstered chair back mounted at corresponding sites to the left and right side linkages, and an upholstered ottoman mounted at corresponding sites to the left and right side linkages, the mechanism being operable by rotation of the handle in a first direction when the recliner is in a closed, fully erect position, to fully extend the ottoman to achieve an intermediate position of said recliner, and being operable when the ottoman is so-extended, by a user's leaning back on an upper portion of the chair back, to fully recline the chair back, being operable when the chair back is fully reclined by the user's concentrating their weight downward on a seat portion of the seat and arm frame unit, to erect the chair back, and being operable by rotation of the handle in a second direction which is opposite to said first direction, to fully retract the ottoman, said rocker lock comprising:

a left lock structure and a right lock structure which are mirror image constructions relative to one another, each of said left and right lock structures including a forward landing link pivotally mounted to the respective side linkage of the rocker chair assembly for rotation between an inactive position wherein a forward end of said forward landing link is spaced above the respective running surface of the respective rail of said base so that said rockable chair assembly is free to rock forwardly, and an active position wherein the forward end of said forward landing link is urged firmly against the respective running surface of the respective rail of said base so that said rockable chair assembly is prevented from rocking forwardly, and each of said left and right lock structures further including a rear landing link pivotally mounted to the respective side linkage of the rocker chair assembly for rotation between an inactive position wherein a rear end of said rear landing link is spaced above the respective running surface of the respective rail of said base so that said rockable chair assembly is free to rock rearwardly, and an active position wherein the rear end of said rear landing link is urged firmly against the respective running surface of the respective rail of said base so that said rockable chair assembly is prevented from rocking rearwardly.

2. The rocker lock of claim 1, wherein each of said forward landing links has a rear end which is pivotally connected to the respective rear landing link by a pin and slot pivot joint allowing a predetermined amount of relative movement therebetween; and left and right lock-operating linkages being integrated into said left and right side linkages respectively and effectively connecting said left lock structure and said torque tube, and said right lock structure and said torque tube respectively, the left and right lock-operating linkages being arranged to rotate said forward and rear landing links between said inactive and active positions thereof upon rotation of said handle, each of said lock operating linkages being effectively connected to the respective lock structure by being pivotally connected to the respective rear landing link.

3. The rocker lock of claim 2, wherein each of said forward landing links has a roller mounted on the forward end thereof for rollingly engaging the respective running surface only when the respective forward landing link of the respective lock structure is in said active position; and each of said rear landing links has a roller mounted on the rear end thereof for rollingly engaging the respective running surface only when the respective rear landing link of the respective lock structure is in said active position.

4. The rocker lock of claim 2, wherein said lock operating linkages are arranged to cause said forward ends of said forward landing links to engage respective ones of said running surfaces before causing said rear ends of said rear landing links to engage respective ones of said running surfaces, as said handle is rotated for moving said rockable chair assembly from said closed, fully erect position, to said intermediate position, for thereby causing said rockable chair assembly to be rocked rearwardly by a predetermined amount as part of said moving.

5. The rocker lock of claim 4, wherein said lock operating linkages are arranged to move past a top dead center line of said torque tube as said handle is rotated in said first direction, causing said rocker lock to produce a "positive force" to assist with complete achievement by said rockable chair assembly of said intermediate position.

6. A spring-assisted, handle-operated rocker recliner in which left and right rocker cams of a rocker cam frame of a rockable chair assembly are supported for rocking forwardly and rearwardly respectively on upwardly presented running surfaces of left and right rails of a base of the recliner, the rockable chair assembly comprising:

a motion chair mechanism mounted to and supported on the rocker cam frame and including left and right side linkages which are coordinately interconnected by a transversely extending torque tube that is journalled for reversible rotation about a longitudinal axis of the torque tube, the torque tube having a handle secured on one end thereof for effecting manual rotation of the torque tube;

an upholstered seat and arm frame unit mounted at corresponding sites to the left and right side linkages;

an upholstered chair back mounted at corresponding sites to the left and right side linkages; and an upholstered ottoman mounted at corresponding sites to the left and right side linkages, the mechanism being operable by rotation of the handle in a first direction when the recliner is in a closed, fully erect position, to fully extend the ottoman to achieve an intermediate position of said recliner, and being operable when the ottoman is so-extended, by a user's leaning back on an upper portion of the chair back, to fully recline the chair back, being operable when the chair back is fully reclined by the user's concentrating the user's weight downward on a seat portion of the seat and arm frame unit, to erect the chair back, and being operable by rotation of the handle in a second direction which is opposite to said first direction, to fully retract the ottoman; and a rocker lock including a left lock structure and a right lock structure which are mirror image constructions relative to one another, each of said left and right lock structures including:

a forward landing link pivotally mounted to the respective side linkage of the rocker chair assembly for rotation between (1) an inactive position wherein a forward end of said forward landing link is spaced above the respective running surface of the respective rail of said base so that said rockable chair assembly is free to rock forwardly, and (2) an active position wherein the forward end of said forward landing link is urged firmly against the respective running surface of the respective rail of said base so that said rockable chair assembly is prevented from rocking forwardly, and a rear landing link pivotally mounted to the respective side linkage of the rocker chair assembly for rotation between (1) an inactive position wherein a rear end of said rear landing link is spaced above the respective running surface of the respective rail of said base so that said rockable chair assembly is free to rock rearwardly, and (2) an active position wherein the rear end of said rear landing link is urged firmly against the respective running surface of the respective rail of said base so that said rockable chair assembly is prevented from rocking rearwardly.

7. The rocker recliner of claim 6, wherein each of said forward landing links has a rear end which is pivotally connected to the respective rear landing link by a pin and slot pivot joint allowing a predetermined amount of relative movement therebetween; and left and right lock-operating linkages being integrated into said left and right side linkages respectively and effectively connecting said left lock structure and said torque tube, and said right lock structure and said torque tube respectively, the left and right lock-operating linkages being arranged to rotate said forward and rear landing links between said inactive and active positions thereof upon rotation of said handle, each of said lock operating linkages being effectively connected to the respective lock structure by being pivotally connected to the respective rear landing link.

8. The rocker recliner of claim 7, wherein each of said forward landing links has a roller mounted on the forward end thereof for rollingly engaging the respective running surface only when the respective forward landing link of the respective lock structure is in said active position; and each of said rear landing links has a roller mounted on the rear end thereof for rollingly engaging the respective running surface only when the respective rear landing link of the respective lock structure is in said active position.

9. The rocker recliner of claim 7, wherein said lock operating linkages are arranged to cause said forward ends of said forward landing links to engage respective ones of said running surfaces before causing said rear ends of said rear landing links to engage respective ones of said running surfaces, as said handle is rotated for moving said rockable chair assembly from said closed, fully erect position, to said intermediate position, for thereby causing said rockable chair assembly to be rocked rearwardly by a predetermined amount as part of said moving.

10. The rocker recliner of claim 9, wherein said lock operating linkages are arranged to move past a top dead center line of said torque tube as said handle is rotated in said first direction, causing said rocker lock to produce a "positive force" to assist with complete achievement by said rockable chair assembly of said intermediate position.

11. A rocker lock for a rocker recliner having a rockable chair assembly supported for rocking forwardly and rearwardly on upwardly presented running surfaces of a base of the recliner, said rocker lock comprising:

a left lock structure and a right lock structure, each of said left and right lock structures including:

a forward landing link pivotally mountable to the rockable chair assembly for rotation between (1) an inactive position wherein a forward end of said forward landing link is spaced above the respective running surface of said base so that said rockable chair assembly is free to rock forwardly, and (2) an active position wherein the forward end of said forward landing link is urged firmly against the respective running surface of said base so that said rockable chair assembly is prevented from rocking forwardly, and a rear landing link pivotally mountable to the rockable chair assembly for rotation between (1) an inactive position wherein a rear end of said rear landing link is spaced above the respective running surface of said base so that said rockable chair assembly is free to rock rearwardly, and (2) an active position wherein the rear end of said rear landing link is urged firmly against the respective running surface of said base so that said rockable chair assembly is prevented from rocking rearwardly.

12. The rocker lock of claim 11, wherein each of said forward landing links has a rear end which is pivotally connected to the respective rear landing link by a pin and slot pivot joint allowing a predetermined amount of relative movement therebetween; and left and right lock-operating linkages being integratable into said rockable chair assembly and being arranged to rotate said forward and rear landing links between said inactive and active positions thereof upon rotation of a handle of the rockable chair assembly, each of said lock operating linkages being effectively connected to the respective lock structure by being pivotally connected to the respective rear landing link.

13. The rocker lock of claim 12, wherein each of said forward landing links has a roller mounted on the forward end thereof for rollingly engaging the respective running surface only when the respective forward landing link of the respective lock structure is in said active position; and each of said rear landing links has a roller mounted on the rear end thereof for rollingly engaging the respective running surface only when the respective rear landing link of the respective lock structure is in said active position.

14. The rocker lock of claim 12, wherein said lock operating linkages are arranged to cause said forward ends of said forward landing links to engage respective ones of said running surfaces before causing said rear ends of said rear landing links to engage respective ones of said running surfaces, as a handle of the rockable chair assembly is rotated for moving said rockable chair assembly from a closed, fully erect position, to an intermediate position, for thereby causing said rockable chair assembly to be rocked rearwardly by a predetermined amount as part of said moving.

15. The rocker lock of claim 14, wherein said lock operating linkages are arranged to move past a top dead center line of a torque tube of said rockable chair assembly as said handle is rotated in a first direction, causing said rocker lock to produce a "positive force" to assist with complete achievement by said rockable chair assembly of said intermediate position.

* * * * *